US006688498B1

(12) United States Patent
McGuffey

(10) Patent No.: US 6,688,498 B1
(45) Date of Patent: Feb. 10, 2004

(54) HOT MELT ADHESIVE SUPPLY SYSTEM WITH INDEPENDENT GEAR PUMP ASSEMBLIES

(75) Inventor: Grant McGuffey, Springfield, TN (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 10/316,935

(22) Filed: Dec. 12, 2002

(51) Int. Cl.[7] ..... B65D 88/54
(52) U.S. Cl. ..... 222/333; 418/175
(58) Field of Search ..... 222/255, 272, 222/318, 333, 504; 418/9, 15, 175

(56) References Cited

U.S. PATENT DOCUMENTS

| | | | | |
|---|---|---|---|---|
| 4,815,954 A | * | 3/1989 | Underwood | 418/196 |
| 5,829,647 A | | 11/1998 | Miller | |
| 6,171,089 B1 | | 1/2001 | Oehman, Jr. | |
| 6,296,463 B1 | | 10/2001 | Allen | |
| 6,422,428 B1 | | 7/2002 | Allen et al. | |

FOREIGN PATENT DOCUMENTS

| | | | | |
|---|---|---|---|---|
| GB | 2 085 081 A | * | 4/1982 | F04C/2/14 |

* cited by examiner

*Primary Examiner*—Paul J. Hirsch
*Assistant Examiner*—Melvin A Cartagena
(74) *Attorney, Agent, or Firm*—Schwartz & Weinrieb

(57) ABSTRACT

A new and improved gear pump assembly, and a new and improved hot melt adhesive dispensing assembly having a plurality of the new and improved gear pump assemblies incorporated therein, wherein each gear pump assembly is mounted upon the dispensing assembly in an entirely independent manner such that each gear pump assembly can be individually removed from the dispensing assembly, and replaced back onto the dispensing assembly, as may be necessary in connection with, for example, repair or maintenance procedures. The independence of each gear pump assembly also effectively prevents damage to or failure of one gear pump assembly from experiencing additional damage as well as from adversely affecting the operation of the other gear pump assemblies. Furthermore, in view of the fact that a driven gear of each gear pump assembly projects radially outwardly through an end face of the gear pump assembly so as to operatively engage a common drive shaft of the applicator assembly, as opposed to having the common drive shaft of the applicator assembly pass through side portions or faces of all of the gear pump assemblies, not only is the aforenoted independent mounting of the plurality of gear pump assemblies upon the dispensing assembly facilitated, but in addition, the need for all external rotary dynamic shaft seals, normally necessarily provided between the common drive shaft and one of the gear members of each gear pump assembly, is eliminated.

28 Claims, 6 Drawing Sheets

HOT MELT ADHESIVE SUPPLY SYSTEM WITH INDEPENDENT GEAR PUMP ASSEMBLIES

FIELD OF THE INVENTION

The present invention relates generally to liquid supply and dispensing assemblies, and more particularly to a new and improved liquid supply assembly, such as, for example, at least one liquid supply assembly for supplying hot melt adhesive or other thermoplastic materials toward a liquid dispensing assembly, wherein the at least one liquid supply assembly preferably comprises a plurality of gear pump assemblies which are separate and independent with respect to each other such that any one gear pump assembly can be readily removed from the operatively associated drive gear manifold, wherein further, if any one gear pump assembly should seize or become frozen, it will not itself experience any further damage or adversely affect any of the other gear pump assemblies, and wherein still further, the rotary gear members of each one of the plurality of independent gear pump assemblies are fixedly mounted upon rotary shafts which are disposed in an entirely enclosed arrangement within each one of the gear pump assemblies such that external dynamic shaft seals, which can have a tendency to fail and thereby lead to leakage of the materials being supplied, are effectively eliminated.

BACKGROUND OF THE INVENTION

In connection with liquid dispensing applicator assemblies, and more particularly, in connection with liquid dispensing applicator assemblies which are being used to dispense hot melt adhesives or other thermoplastic materials, a typical applicator assembly conventionally comprises a supply source of the adhesive or thermoplastic material, means for precisely or accurately metering the adhesive or thermoplastic material through the applicator, and means for pumping the adhesive or thermoplastic material to the metering means of the applicator. In connection with particular applications or procedures, it is usually necessary to accurately or precisely meter the liquids being dispensed so as to ensure that a specific or predetermined volume of the liquid is in fact dispensed within a specific or predetermined period of time. For example, in connection with the dispensing of hot melt adhesive materials, it is often necessary to provide a plurality of individual pumps for providing predetermined volumes of the adhesive material, which may in fact comprise similar or different volume amounts or quantities, to discrete, separate, or respective applicator outlets. The individual pumps conventionally comprise rotary gear pumps which are operatively connected to a drive motor through means of a common rotary drive shaft, and dynamic seals, that is, stationary seals which are operatively disposed around or operatively associated with the rotary drive shaft, are provided for effectively preventing any external or outward leakage of the hot melt adhesive material from the applicator assembly at the interfaces defined between the rotary drive shaft and the rotatably driven gears of the rotary gear pumps. An example of such a conventional or PRIOR ART rotary gear pump hot melt adhesive applicator or dispensing assembly is disclosed, for example, within U.S. Pat. No. 6,422,428 which issued to Allen et al. on Jul. 23, 2002.

More particularly, as disclosed within FIG. 1, which corresponds substantially to FIG. 3 of the aforenoted patent, one of a plurality of gear pump assemblies, as utilized within a hot melt adhesive applicator assembly, is disclosed at 20, and it is seen that each gear pump assembly 20 comprises a conventional sandwiched construction comprising three plates 220,222,224 encompassing or enclosing a pair of gears 230,232. Gear 230 comprises an idler gear, whereas gear 232 comprises a driven gear operatively mounted upon a rotary drive shaft 234. The rotary drive shaft 234 has a hexagonal cross-sectional configuration so as to define the drive connection with the driven gear 232, and it is noted that the drive shaft 234 extends through each gear pump assembly 220. A pair of seals 240, only one of which is shown in FIG. 1, are provided within suitable apertures defined within the end plates 220,224 so as to annularly surround the rotary drive shaft 234 and thereby prevent any leakage of the hot melt adhesive material out from the gear pump assembly 20. A threaded port 244 is provided for receiving a temperature sensor for ensuring that each gear pump 20 has been heated to a predetermined temperature level prior to operation, and a rupture disk assembly 242 is provided for pressure relief under over-pressure conditions. A bore 248 is provided for receiving a pressure transducer which can read output liquid pressure, and when the pressure transducer is not being utilized, a plug assembly 250 is adapted to be disposed within the bore 248.

While a gear pump assembly 20 such as that disclosed within the aforenoted patent is operatively viable, the gear pump assembly 20 of the aforenoted type nevertheless exhibits several operative drawbacks and disadvantages. Firstly, for example, it is noted that in view of the fact that the seals 240 of the gear pump assembly 20 are located upon external surface portions of the end plates 220,224 of the gear pump assembly 20, should the seals 240 experience failure, external leakage of the hot melt adhesive material poses obvious maintenance problems, not to mention the likelihood of the leaking hot melt adhesive material causing fouling of other operative components of the gear pump assembly 20. In addition, it has been noted in the aforenoted patent that the rotary drive shaft 234 extends through each one of the gear pump assemblies 20. Accordingly, if, for example, one of the gear pump assemblies 20 should experience failure or exhibit leakage, and therefore needs to be removed for repair or replacement, the particular gear pump assembly 20 cannot in fact simply be removed from the overall applicator assembly. To the contrary, the rotary drive shaft 234 must firstly be removed so as to subsequently permit the particular gear pump assembly 20 to be removed and separated from the other gear pump assemblies 20 in order to repair or replace the failed or leaking gear pump assembly 20. Upon completion of the repair or replacement of the failed or leaking gear pump assembly 20, the repaired gear pump assembly 20, or the new gear pump assembly 20, can effectively be re-inserted into the bank or array of gear pump assemblies 20 whereupon, still further, the rotary drive shaft 234 can be re-installed in connection with the plurality of rotary gear pump assemblies 20 so as to again be operatively engaged with each one of the plurality of rotary gear pump assemblies 20. Still yet further, if one of the gear pump assemblies 20 should experience failure and effectively become frozen, the failed and frozen gear pump assembly 20 will effectively prevent rotation of the rotary drive shaft 234 whereby the failed or frozen gear pump assembly 20 can experience or undergo further damage, and in turn, cause operative freezing or failure of the other gear pump assemblies 20 which are rotatably engaged with and driven by means of the common rotary drive shaft 234.

Accordingly, a need exists in the art for a new and improved gear pump assembly for use in connection with a liquid dispensing assembly wherein the liquid dispensing assembly comprises at least one gear pump assembly, and preferably a plurality of gear pump assemblies which are mounted upon the liquid dispensing assembly such that all of the gear pump assemblies are independent with respect to each other, wherein the plurality of gear pump assemblies are operatively driven by means of a common rotary drive shaft in such a manner that no external dynamic seals are required, that any particular one of the gear pump assemblies can be readily removed from the array or bank of gear pump assemblies independently of the other gear pump assemblies, and subsequently be re-inserted into the array or bank of gear pump assemblies, or replaced by means of a new gear pump assembly, and wherein still further, as a result of the gear pump assemblies being independent with respect to each other and not being operatively driven by means of a common internally disposed rotary drive shaft, then should a particular one of the gear pump assemblies experience failure, such failed gear pump assembly will not experience additional damage or cause the other gear pump assemblies to experience freezing or failure.

OBJECTS OF THE INVENTION

Accordingly, it is an object of the present invention to provide a new and improved gear pump assembly, and a new and improved liquid dispensing assembly having the new and improved gear pump assembly incorporated therein.

Another object of the present invention is to provide a new and improved gear pump assembly, and a new and improved liquid dispensing assembly having the new and improved gear pump assembly incorporated therein, wherein the new and improved gear pump assembly effectively overcomes the various operational drawbacks and disadvantages characteristic of PRIOR ART gear pump and liquid dispensing assemblies.

An additional object of the present invention is to provide a new and improved gear pump assembly, and a new and improved liquid dispensing assembly having the new and improved gear pump assembly incorporated therein, wherein each gear pump assembly is operatively engaged with its own independent drive mechanism through means of an end face portion of the gear pump assembly, as opposed to being operatively engaged with a common drive shaft which passes through the sides of all of the gear pump assemblies, whereby the rotary gear drive mechanism for each gear pump assembly is entirely enclosed or encased internally within each gear pump assembly such that external dynamic seals are effectively eliminated so as to prevent any external leakage, of the liquid being supplied, by each gear pump assembly.

A further object of the present invention is to provide a new and improved gear pump assembly, and a new and improved liquid dispensing assembly having the new and improved gear pump assembly incorporated therein, wherein each gear pump assembly is independently mounted upon a drive gear manifold whereby each gear pump assembly is able to be mounted upon, and dismounted from, the drive gear manifold without operatively affecting the other gear pump assemblies such that if a particular one of the gear pump assemblies needs to be removed, repaired, or replaced, that particular or individual gear pump can in fact be removed, repaired, and replaced without requiring the disassembly of any of the other gear pump assemblies with respect to the drive gear manifold.

A last object of the present invention is to provide a new and improved gear pump assembly, and a new and improved liquid dispensing assembly having the new and improved gear pump assembly incorporated therein, wherein each gear pump assembly is independently mounted upon a drive gear manifold whereby each gear pump assembly is able to be mounted upon, and dismounted from, the drive gear manifold without operatively affecting the other gear pump assemblies such that if a particular one of the gear pump assemblies should experience failure, such failure will not result in any additional damage to the failed gear pump assembly, and in turn, will not cause seizure or failure of the other gear pump assemblies in view of the fact that the gear pump assemblies of the present invention liquid dispensing assembly are not operatively interconnected together by means of a common drive shaft.

SUMMARY OF THE INVENTION

The foregoing and other objectives are achieved in accordance with the teachings and principles of the present invention through the provision of a new and improved gear pump assembly, and a new and improved liquid dispensing assembly having the new and improved gear pump assembly incorporated therein, wherein each gear pump assembly comprises a pair of side plates and a central plate which is sandwiched between the pair of side plates. The central plate has a plurality of cut-out regions defined therein for rotatably accommodating a driven gear, a pump drive gear, and a pump idler gear, and the pair of side plates are similarly provided with a plurality of recesses for rotatably accommodating bearing members within which rotary shafts, operatively connected respectively to the driven gear, the pump drive gear, and the pump idler gear, are rotatably disposed. Each individual gear pump assembly is adapted to be independently mounted upon a drive gear manifold within which a pump drive shaft is rotatably mounted. A circumferential portion of the driven gear of each individual gear pump assembly projects outwardly through an end face of each gear pump assembly, and a drive gear, rotatably mounted upon the pump drive shaft disposed within the drive gear manifold, is adapted to be enmeshed with each driven gear of the gear pump assembly. In this manner, all rotatable components of each gear pump assembly are disposed entirely internally within each gear pump assembly whereby external shafting, and the need for external dynamic seals, has effectively been eliminated, and in addition, the independent mounting of each gear pump assembly upon the drive gear manifold permits each gear pump assembly to be individually or separately operated, serviced, maintained, repaired, or replaced without operatively affecting any of the other gear pump assemblies.

BRIEF DESCRIPTION OF THE DRAWINGS

Various other objects, features, and attendant advantages of the present invention will be more fully appreciated from the following detailed description when considered in connection with the accompanying drawings in which like reference characters designate like or corresponding parts throughout the several views, and wherein.

DETAILED DESCRIPTION OF THE PREFERRED EMBODIMENT

Figure 2:
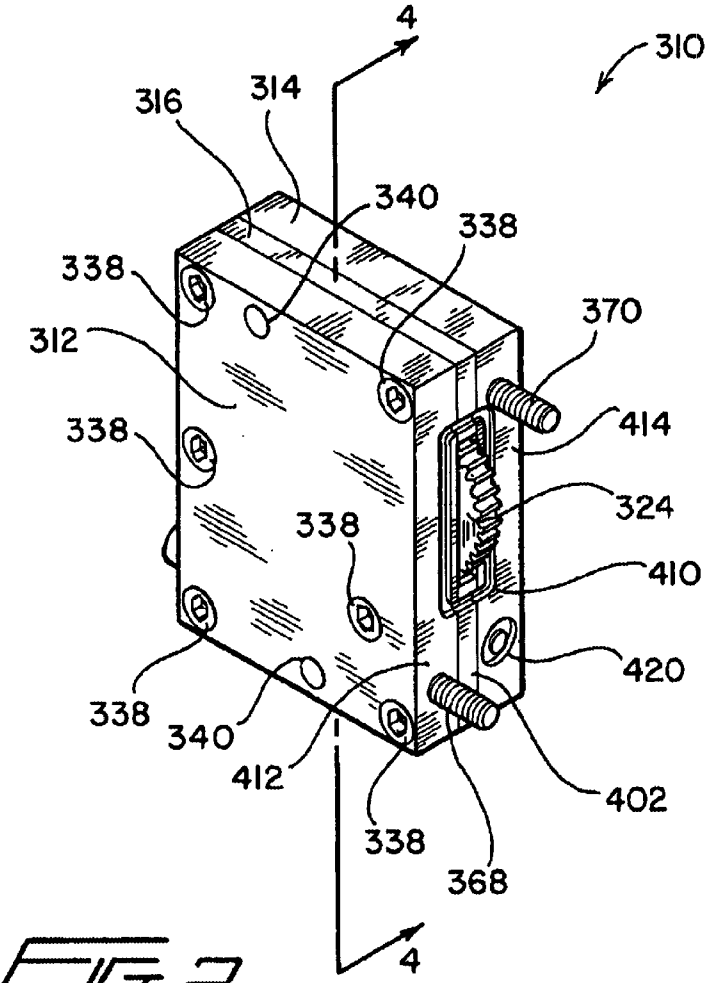
FIG. 2 is an assembled perspective view of a gear pump assembly constructed in accordance with the principles and teachings of the present invention and showing the cooperative parts thereof.
Figure 1:
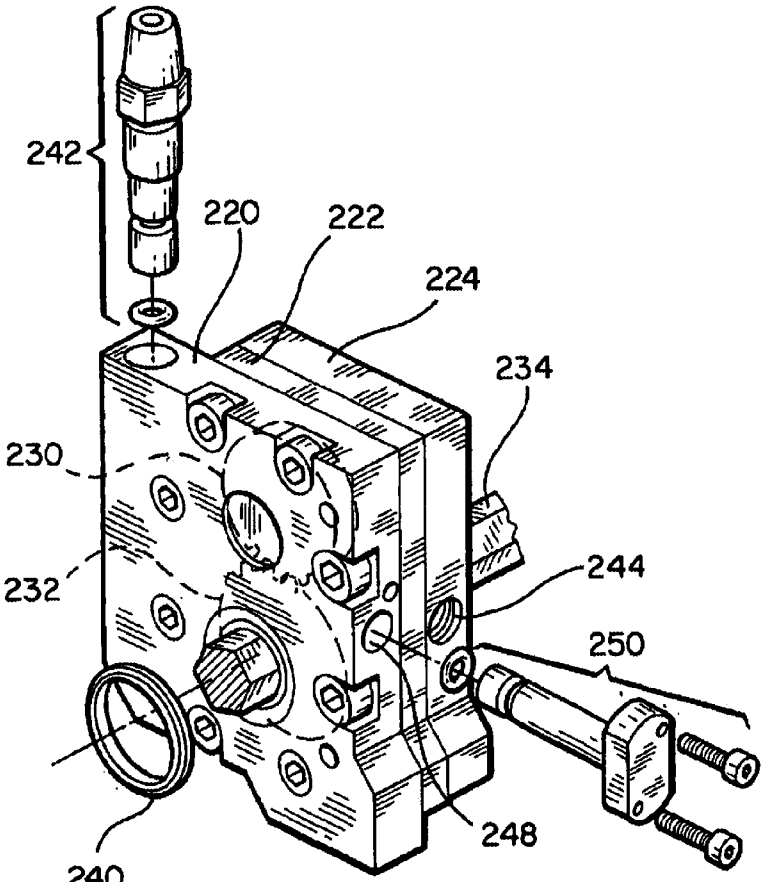
FIG. 1 (PRIOR ART)
FIG. 1 is a partially exploded perspective view of a conventional PRIOR ART gear pump assembly.
Figures 3, 8:
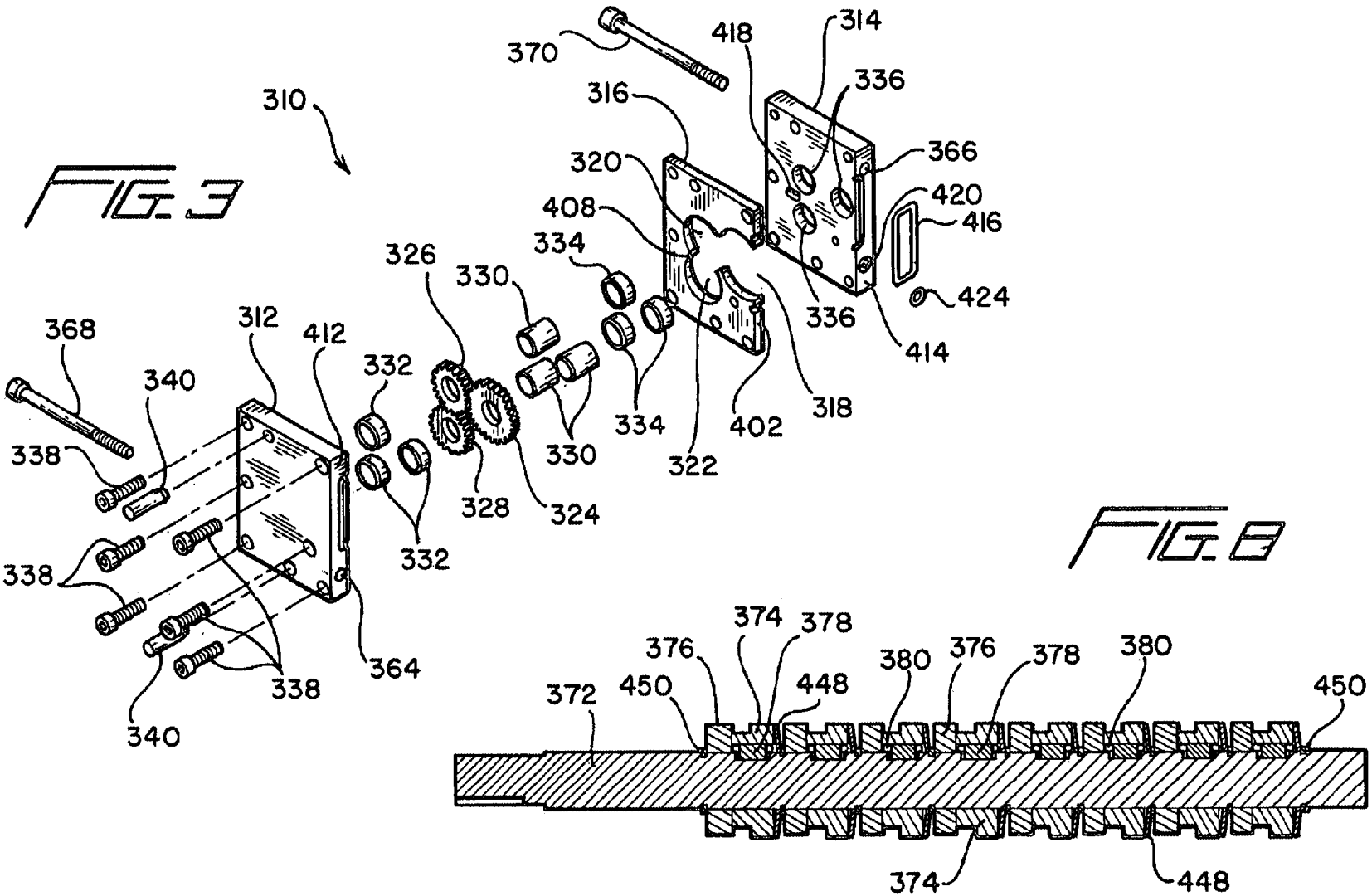
FIG. 3 is an exploded perspective view of the new and improved gear pump assembly as constructed in accordance with the principles and teachings of the present invention, as disclosed within FIG. 2, and showing the cooperative parts thereof.
FIG. 8 is an axially oriented cross-sectional view of the rotary drive shaft, as shown in FIG. 5, illustrating the plurality of drive gears, and torque-overload release clutch mechanisms operatively associated with each one of the drive gears, as mounted upon the rotary drive shaft so as to facilitate the independent mounting and operation of each gear pump assembly in connection with the common externally disposed rotary drive shaft.
Figure 4:
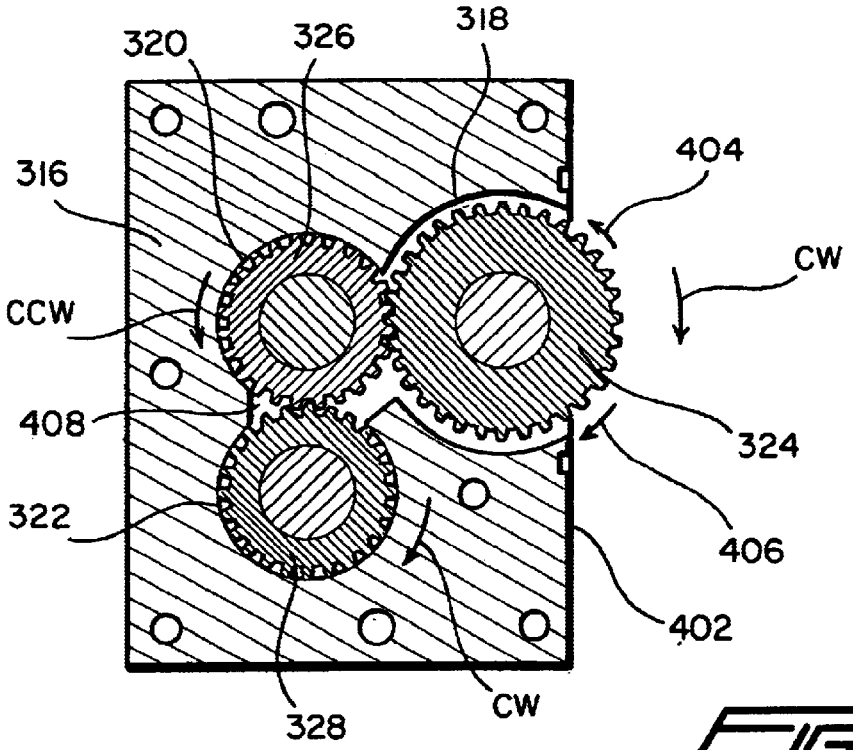
FIG. 4 is a cross-sectional view of the new and improved gear pump assembly as constructed in accordance with the teachings and principles of the present invention and as taken along the lines 4—4 of FIG. 2.

Referring now to the drawings, and more particularly to FIGS. 2–4 thereof, a new and improved gear pump assembly, constructed in accordance with the principles and teachings of the present invention, is disclosed and is generally indicated by the reference character 310. As may best be seen in FIGS. 2 and 3, the new and improved gear pump assembly 310 comprising a housing defined by means of a sandwiched construction which comprises a pair of side plates 312,314 and an intermediate or central plate 316. As may best be seen in FIGS. 3 and 4, the central or intermediate plate 316 is provided with a plurality, that is, three, of cut-out regions 318,320,322, and a plurality, that is, three, of gear members 324,326,328 are respectively rotatably disposed within the cut-out regions 318,320,322 such that the three gear members 324,326,328 are disposed in a substantially co-planar manner with respect to the central or intermediate plate 316. More particularly, and as will become more fully apparent hereinafter in connection with the operation of the gear pump assembly 310, the gear member 324 comprises a driven gear, gear member 326 comprises a pump drive gear which is operatively enmeshed with the driven gear 324, and gear member 328 comprises a pump idler gear which is operatively enmeshed with the pump drive gear 326. Each one of the gear members 324,326,328 is respectively fixedly mounted upon a pin, axle, or shaft member 330, and opposite ends of the gear pins, axles, or shafts 330 are rotatably disposed within bearing members 332,334. It is further seen that the side plate 314 is provided with a plurality, that is, three, of recesses 336 which are coaxially disposed with respect to the cut-out regions 318, 320, 322, defined within the central or intermediate plate 316, and which are adapted to house or accommodate the bearing members 334. Recesses, not shown but similar to the recesses 336, are likewise provided within the side plate 312 so as to accommodate or house the bearing members 332, and in this manner, the gear members 324,326, 328 are effectively rotatably mounted within, or with respect to, the side plates 312,314. It is particularly noted that the recesses 336 defined within the side plate 314, as well as the corresponding recesses, not shown, defined within side plate 312, are only defined, in effect, upon or within the interior side surfaces of the side plates 312,314 so as not to extend entirely through the side plates 312,314 as do, for example, the cut-out regions 318,320,322 defined within the central or intermediate plate 316. This particular structural arrangement, by means of which the gear members 324,326, 328 are mounted upon the side plates 312,314 of the gear pump assembly 310, is a critically important, and unique and novel, feature characteristic of the gear pump assembly 310 as constructed in accordance with the principles and teachings of the present invention.

More particularly, it is noted that all of the rotary shafts 330 and the bearing members 332,334 are disposed in an entirely enclosed or encased manner within the internal confines of the sandwiched plate construction comprising the three side and intermediate plate members 312,314,316 of the gear pump assembly 310. Viewed from a different point of view, none of the rotary shafts 330 and bearing members 332, 334 project outwardly through, or extend externally of, the side plates 312,314, and in this manner, the need for external dynamic shaft seals, which have often conventionally proven to be sources of external leakage of the fluid being pumped and dispensed by means of the gear pump assembly 310, has effectively been eliminated. It is noted further that in order to fixedly secure the three plate members 312,314,316 of the gear pump assembly 310 together, as well as to ensure the proper coaxial alignment of the recesses 336, defined within the side plates 312,314, with respect to the cut-out regions 318,320,322, defined within the central or intermediate plate 316, so as to properly house, accommodate, and mount the three gear members 324,326, 328, and their associated shafts 330 and bearing members 332,334, upon the plate members 312,314,316 of the gear pump assembly 310, a plurality of screws 338 and alignment pins 340 extend through suitable bores, not numbered for clarity purposes, defined within the three plate members 312,314,316.

Figure 5:
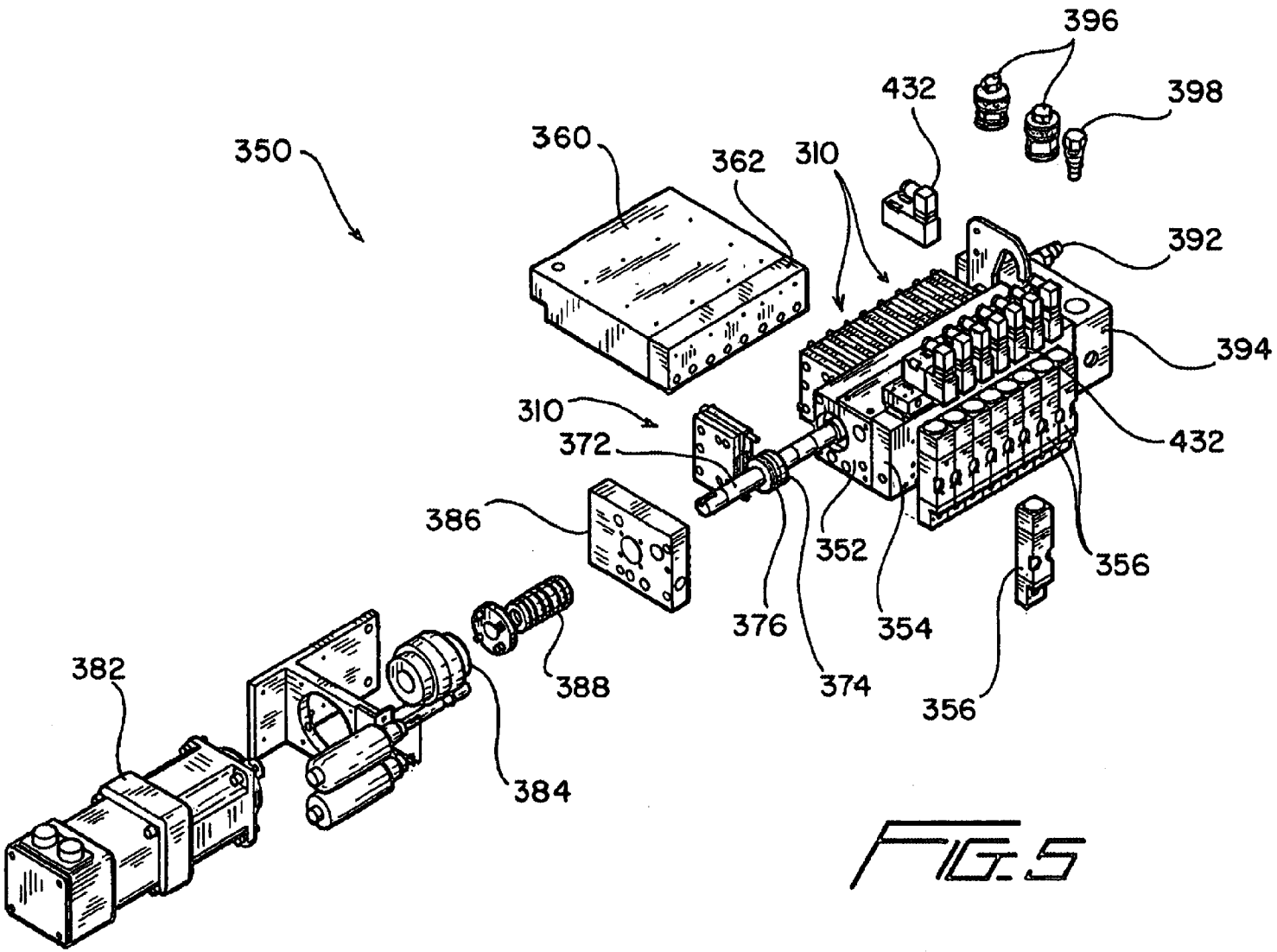
FIG. 5 is an exploded perspective view of a hot melt adhesive dispensing assembly having a plurality of gear pump assemblies, as disclosed within FIGS. 2–4, incorporated therein.
Figure 6:
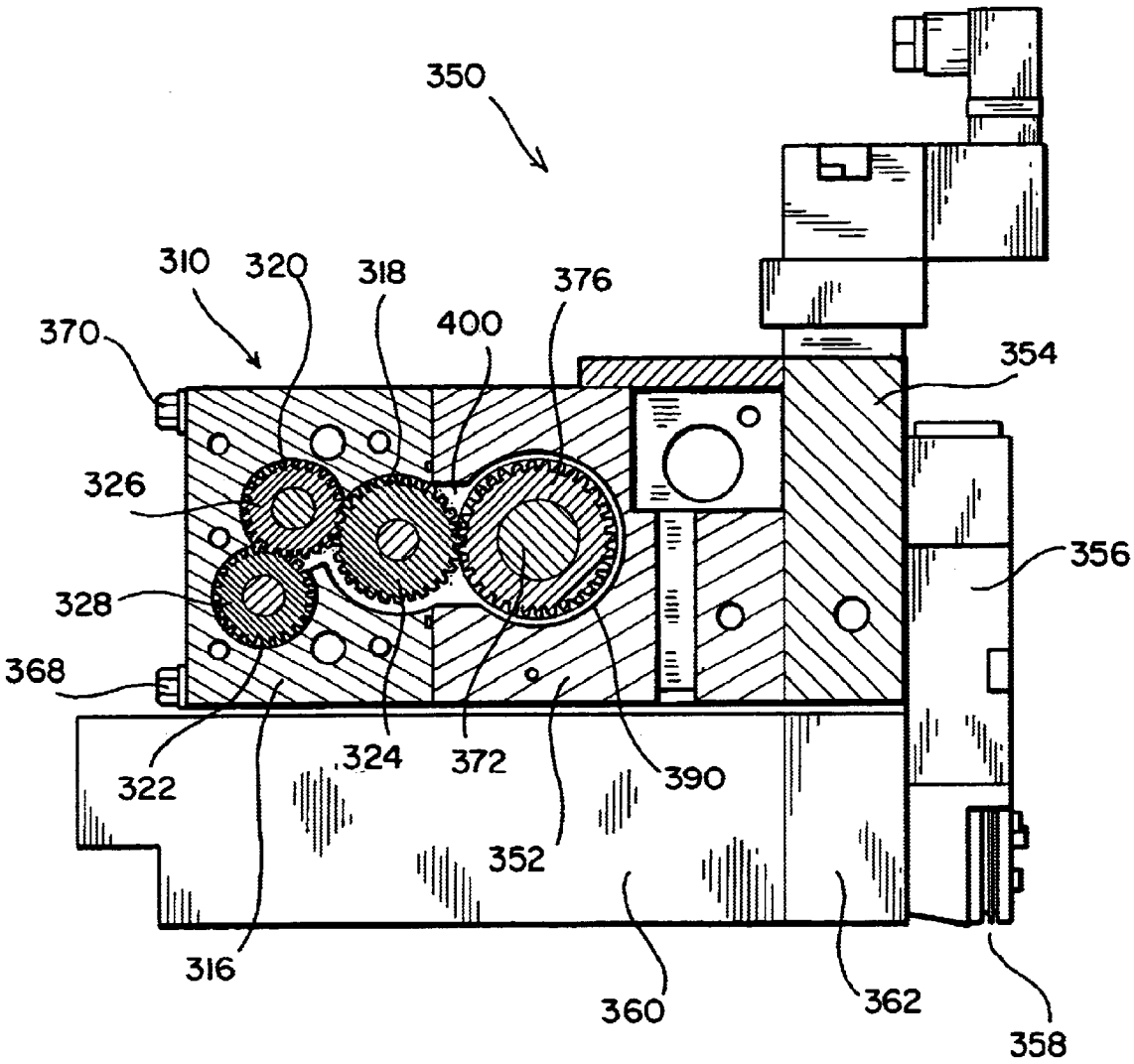
FIG. 6 is a cross-sectional view through an assembled hot melt adhesive dispensing assembly, similar to the exploded hot melt adhesive dispensing assembly disclosed within FIG. 5, as taken along a plane through the central or intermediate plate of one of the gear pump assemblies showing the cooperative details defined between the gear pump assembly and the drive gear member of the drive gear manifold of the hot melt adhesive dispensing assembly.
Figure 7:
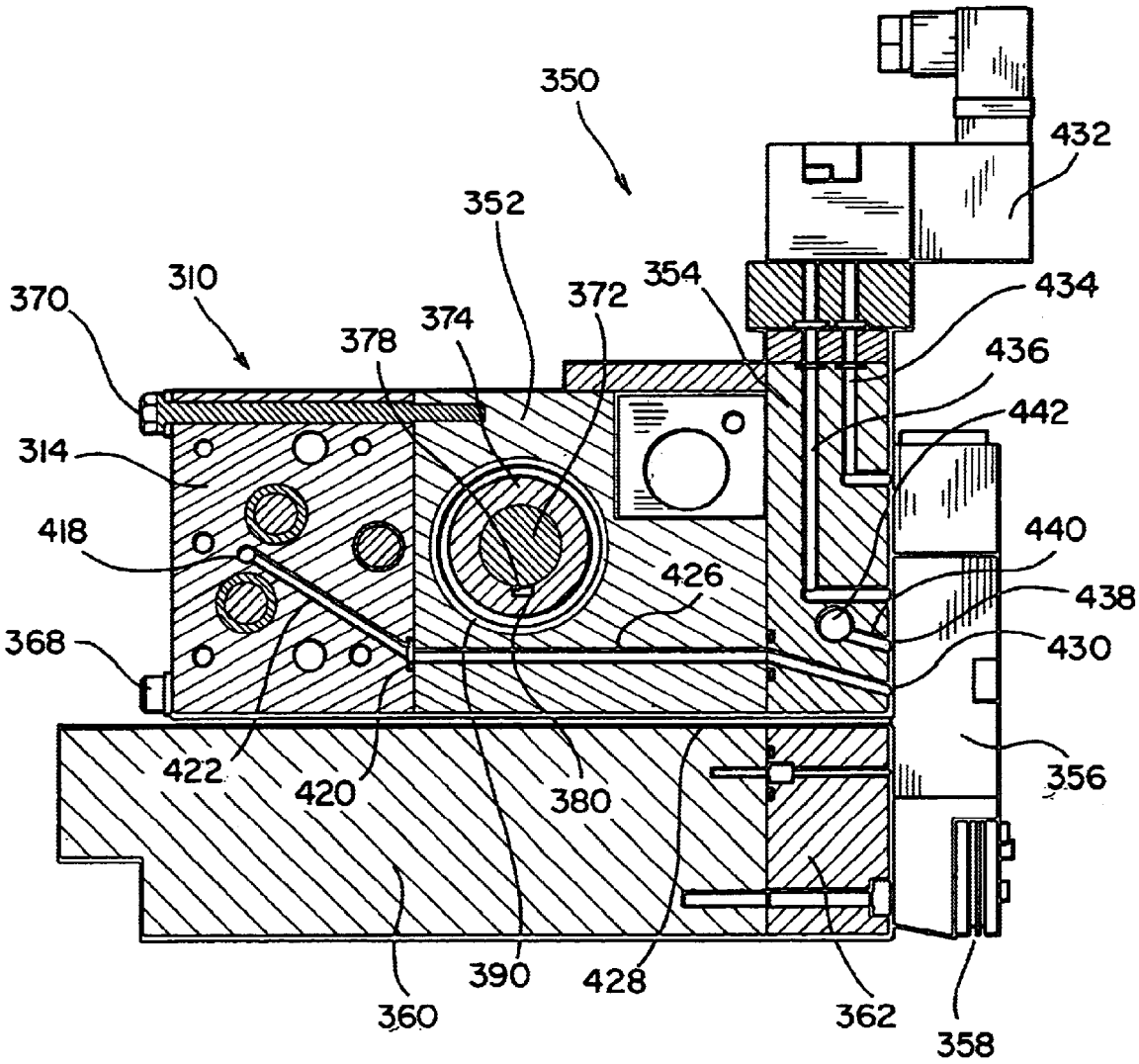
FIG. 7 is a cross-sectional view, similar to that of FIG. 6, as taken, however, along a plane through one of the side plates of one of the gear pump assemblies so as to show, in greater detail, the various fluid flow paths through the gear pump assembly, the drive gear manifold, and the adapter manifold components of the hot melt adhesive dispensing assembly.

With reference now being made to FIGS. 5–7, a new and improved hot melt adhesive dispensing assembly, having operatively incorporated therein or associated therewith at least one, and preferably a plurality, of the new and improved gear pump assemblies 310 as specifically disclosed within FIGS. 2–4, is disclosed and is generally indicated by the reference character 350. Each dispensing assembly 350 is seen to comprise a drive gear manifold 352, an adapter manifold 354, and a control valve assembly 356 which is mounted upon a front face of the adapter manifold 354, and each one of the control valve assemblies 356 has a downwardly oriented dispensing nozzle 358 from which the hot melt adhesive material can be dispensed onto, for example, a suitable substrate or the like. An air pre-heater manifold is also disclosed at 360 for providing heated air to be used as a carrier in conjunction with the hot melt adhesive material, and an air heater adapter 362 is operatively associated with and interposed between the air pre-heater manifold 360 and the at least one or the plurality of control valve assemblies 356 so as to provide or conduct the heated air from the air pre-heater manifold 360 to the at least one or plurality of control valve assemblies 356. As can be additionally seen and appreciated from FIGS. 2, 3, 6, and 7, the side plates 312,314 of each gear pump assembly 310 are respectively provided with through-bores 364,366 through which first and second headed bolts or similar fasteners 368,370 are adapted to be passed whereby the at least one or plurality of gear pump assemblies 310 can be secured to the drive gear manifold 352 in a side-by-side manner or array.

The drive gear manifold 352 comprises a drive shaft 372 which extends axially therethrough, and as can be appreciated from a comparison of FIGS. 5–7, the axially extending drive shaft 372 has a plurality of gear pump, torque-overload release clutch mechanisms 374 mounted thereon at predetermined axially spaced positions thereof. The gear pump, torque-overload release clutch mechanisms 374 are operatively connected to a plurality of pump drive gears 376 which are also mounted upon the axially extending drive shaft 372 at predetermined axially spaced positions thereof, and it is to be noted that such predetermined axially spaced positions of the pump drive gears 376 effectively correspond to the axial spacing defined between adjacent or successive gear pump assemblies 310, which are disposed within the array of gear pump assemblies 310 as best seen in FIG. 5, so as to permit each one of the pump drive gears 376 to be drivingly enmeshed with a respective one of the driven gears 324 of each gear pump assembly 310 as best seen in FIG. 6. As can best be seen in FIG. 7, the axially extending drive shaft 372 also has a plurality of key members 378 fixedly mounted thereon at predetermined axially spaced positions for operatively engaging keyways 380 defined within each one of the gear pump, torque-overload release clutch mechanisms 374 so as to effectively define a drive connection therebetween.

The provision of the rotary drive shaft 372, the key members 378, the torque-overload release clutch mechanisms 374, and the pump drive gears 376 structural components within the applicator assembly 350 enables any one of the plurality of gear pump assemblies 310 to be independently engaged with and disengaged from its respective one of the plurality of pump drive gears 376 without adversely affecting the operation of the other ones of the gear pump assemblies 310 as will be discussed in greater detail hereinafter. In order to provide the necessary rotary drive to the axially extending drive shaft 372, it is noted further that a drive motor and gearbox assembly 382 is adapted to be operatively connected to the drive shaft 372 through means of a suitable coupling 384, as best seen in FIG. 5, and it is seen that the drive shaft 372 is adapted to pass through an end plate 386 whereby the end plate 386 can effectively serve as a bearing support for the drive shaft 372. A seal assembly 388 is also adapted to be mounted within the end plate 386 so as to prevent the leakage of any liquid, that is, for example, the adhesive materials that are to be dispensed, from peripheral regions disposed around the drive shaft 372 when, for example, each one of a plurality of axially spaced liquid supply cavities 390, which are respectively defined around each one of the pump drive gears 376, is pressurized. It is noted that one of the liquid supply cavities 390 can best be seen in FIGS. 6 and 7.

Continuing further, and with reference again being made to FIG. 5, the liquid to be dispensed from the dispensing nozzles 358 of the dispensing assembly 350 is introduced into the drive gear manifold 352 of the dispensing assembly 350 through means of a liquid inlet supply port 392 which is operatively mounted upon a filter block 394. At least one filter assembly 396 is also mounted upon the filter block 394 for filtering the incoming liquid, and a pressure relief mechanism 398 is likewise mounted upon the filter block 394 for operative cooperation with the liquid inlet support port 392 and the at least one filter assembly 396 so as to maintain a predetermined pressure level characteristic of the incoming or supply adhesive liquid material. The liquid inlet supply port 392 is fluidically connected, through means of the one or more filter assemblies 396, to each one of the liquid supply cavities 390 defined within the drive gear manifold 352, and each one of the liquid supply cavities 390 is, in turn, fluidically connected to a liquid accumulator cavity 400 which is located at the interface defined between the drive gear manifold 352 and the central or intermediate plate 316 of each one of the gear pump assemblies 310. As is apparent from FIGS. 2, 4, 6, while a first arcuate portion of each driven gear member 324 is drivingly enmeshed with the pump drive gear 326, a second arcuate portion of each driven gear member 324 projects radially outwardly through an end face 402 of the central or intermediate plate 316 of each one of the gear pump assemblies 310 so as to be drivingly enmeshed with a respective one of the pump drive gears 376.

Accordingly, as the drive motor and gearbox assembly 382 causes rotation of the drive shaft 372, and therefore each pump drive gear 376, in the counterclockwise direction, as viewed in FIG. 6, the driven gear 324 of each gear pump assembly 310 is driven in the clockwise direction CW, the pump drive gear 326 is driven in the counterclockwise direction CCW, and the pump idler gear 328 is driven in the clockwise direction CW, as viewed in FIG. 4. As can additionally be best seen from FIG. 4, the diametrical extent of the cut-out region 318 defined within the central or intermediate plate 316 of each gear pump assembly 310 is substantially larger than the diametrical extent of the driven gear 324 of each gear pump assembly 310. Accordingly, when the liquid, which is to be pumped through the gear pump assembly 310 and ultimately dispensed from the dispensing assembly 350, is supplied to each liquid supply cavity 390 and each liquid accumulator cavity 400, oppositely oriented liquid flow paths 404,406 are effectively defined between the inner peripheral wall of cut-out region 318 and the outer periphery of the driven gear 324 despite the fact that the driven gear 324 is being driven in the clockwise direction CW. Subsequently, the liquid portions, originally flowing along the flow paths 404, 406, are respectively entrained by means of the pump drive gear 326 and the pump idler gear 328 and conducted toward a common liquid inlet cavity 408 which is effectively formed at the interface defined between the cut-out regions 320,322 formed within the central or intermediate plate 316 as may best be appreciated from FIGS. 3 and 4. It is also to be noted, as may best be appreciated from FIGS. 3 and 4, that in conjunction with the radially outward projection of the arcuate portion of the driven gear 324 from the end face 402 of central or intermediate plate 316 of each gear pump assembly 310, a peripheral gland or recess 410 is defined within the end faces 412, 402,414 of the side and intermediate plates 312,314,316 of each gear pump assembly 310 for accommodating or housing an O-ring member 416 which has a substantially rectangular configuration. In this manner, when each gear pump assembly 310 is fixedly mounted upon the drive gear manifold 352, the O-ring members 416 will respectively prevent any leakage of the liquid out from each one of the gear pump assemblies 310.

With reference now being made to FIGS. 3 and 7, in conjunction with each one of the aforenoted common liquid inlet cavities 408 which are effectively formed at the interfaces defined between the cut-out regions 320,322 formed within each one of the central or intermediate plates 316 of each gear pump assembly 310, a liquid outlet cavity 418 is formed within the side plate 314 of each one of the gear pump assemblies 310 so as to be in fluidic communication with the common liquid inlet cavity 408. A pump outlet port 420 is defined within a lower portion of the side plate 314 of each gear pump assembly 310, as best seen in FIGS. 2, 3, and 7, and a fluid passageway 422, internally defined within the side plate 314, fluidically connects the liquid outlet cavity 418 to the pump outlet port 420. An O-ring seal member 424, as shown in FIG. 3, is adapted to be disposed around each pump outlet port 420 in a manner similar to that of O-ring member 416 so as to respectively prevent any leakage of the liquid out from each one of the gear pump assemblies 310 when each gear pump assembly 310 is fixedly mounted upon the drive gear manifold 352. As can be further appreciated from FIG. 7, once a metered flow of the adhesive material is outputted through means of the pump outlet port 420 of each gear pump assembly 310, adhesive material is conducted through a fluid passageway 426, which extends through the drive gear manifold 352, and a fluid passageway 428 which extends through the adapter manifold 354 so as to fluidically connect the fluid passageway 426 to a control valve inlet port 430 defined within each one of the control valve assemblies 356.

A plurality of solenoid valve assemblies 432 are fixedly mounted atop the adapter manifold 354, and accordingly, each one of the solenoid valve assemblies 432 alternatively controls the admission of high-pressure air to an OPEN air line 434 and a CLOSE air line 436 operatively associated with each one of the control valve assemblies 356. Accordingly, when each one of the solenoid valve assemblies 432 transmits a suitable pneumatic signal through the OPEN air line 434 so as to cause its associated control valve assembly 356 to be moved to its OPENED position, the adhesive material to be dispensed is conducted through the dispensing nozzle 358 operatively associated with the control valve assembly 356 such that an accurate metered output flow of the adhesive material is achieved. Alternatively, when each solenoid valve assembly 432 transmits a suitable pneumatic signal through the CLOSED air line 436 so as to cause the control valve assembly 356 to be moved to its CLOSED position, the adhesive material is prevented from flowing to the dispensing nozzle 358 and is re-directed to a return port 438 which is fluidically connected to a fluid passageway 440. Fluid passageway 440 is fluidically connected to a common return passageway 442 which, in turn, is fluidically connected to the filter block 394, whereby the returned adhesive material can again be conducted to the liquid supply cavity 390.

Figure 9:
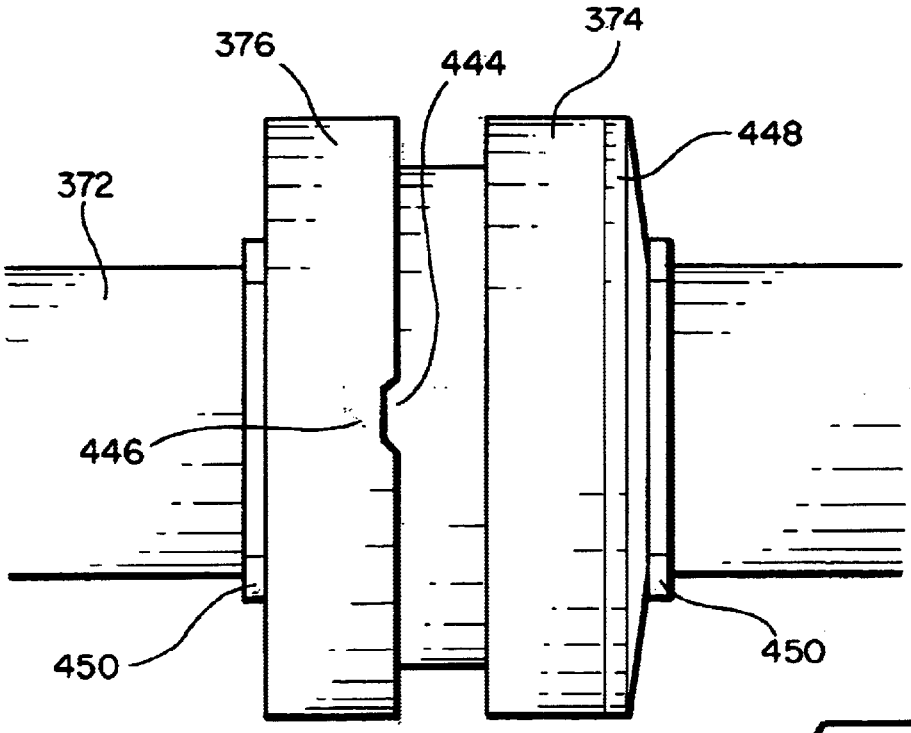
FIG. 9 is an enlarged elevational view showing the details of the operative components defined between each one of the drive gears and each one of the torque-overload release clutch mechanisms for achieving the torque-overload release operation as required.

In accordance with a last, critically important, unique, and novel feature characteristic of the present invention, as facilitated by means of the teachings and principles embodiment within the structural arrangement of the various components of the applicator assembly 350, it was previously noted the provision of the rotary drive shaft 372, the key members 378, the torque-overload release clutch mechanisms 374, and the pump drive gears 376 structural components within the dispensing assembly 350 enables any one of the plurality of gear pump assemblies 310 to be independently engaged with and disengaged from its respective one of the plurality of pump drive gears 376 without adversely affecting the operation of the other ones of the gear pump assemblies 310. The details of such structural arrangement will now be provided in conjunction with, or as a result of reference being made to, FIGS. 8 and 9. More particularly, as shown within FIGS. 8 and 9, the rotary drive shaft 372 has the plurality of pump drive gears 376 mounted thereon at predetermined axially spaced locations, and in a similar manner, the plurality of gear pump overload-torque release clutch mechanisms 374 are respectively mounted upon the rotary drive shaft 372 so as to be respectively disposed adjacent to individual ones of the pump drive gears 376. Each one of the clutch mechanisms 374 is rotatably fixed upon the rotary drive shaft 372 by means of the key members 378 of the rotary drive shaft 372 being respectively disposed within the keyways 380 of the clutch mechanisms 374. As best seen in FIG. 9, a peripheral side portion of each one of the clutch mechanisms 374 is further provided with a tang or detent 444 which has a substantially trapezoidal configuration, and a peripheral side portion of each one of the pump drive gears 376 is similarly provided with a recess or notch 446 which likewise has a substantially trapezoidal configuration so as to receive the tang or detent 444 of the clutch mechanism 374 in a mated or seated manner. A Belleville washer 448 is mounted upon the rotary drive shaft 372 so as to engage the opposite side of each clutch mechanism 374, and in this manner, it can be readily appreciated that as a result of the engagement of the Belleville washer 448 with the clutch mechanism 374, the clutch mechanism 374 is biased toward the pump drive gear 376 such that the tang or detent 444 of the clutch mechanism 374 is normally disposed within the notch or recess 446 of the pump drive gear 376 so as to normally impart rotary drive to the pump drive gear 376 from the rotary drive shaft 372 through means of the clutch mechanism 374.

If, however, an operational manlfunction occurs in connection with any particular one of the gear pump assemblies 310 operatively associated with a particular one of the pump drive gears 376 such that, for example, the particular gear pump assembly 310 jams or becomes frozen, the rotary torque required to drive such gear pump assembly 310 will now be substantially increased. Consequently, as a protection measure which is effectively inherent within the drive system, the torque-overload release clutch mechanism 374, which is operatively associated with the particular pump drive gear 376 engaged with that particular gear pump assembly 310, will now operatively release from the particular pump drive gear 376, against the biasing force of the Belleville washer 448, due to such increased torque levels.

It can therefore be further appreciated that by means of this structural arrangement, each gear pump assembly 310, operatively associated with the rotary drive shaft 372 and a particular one of the pump drive gears 376 mounted thereon, is rendered entirely operatively independent of the other gear pump assemblies 310. This mounting arrangement of each gear pump assembly 310 prevents further damage to the failed gear pump assembly 310, as well as the generation of damage to any of the other gear pump assemblies 310. More particuarly, in accordance with the protective mounting arrangement, the defective gear pump assembly 310 can be removed from its operative connection with the respect to the rotary drive shaft 372 and its operatively associated pump drive gear 376, as a result of the removal and disengagement of the fastener bolts 368,370 from the drive gear manifold 352, the pump assembly 310 can be subsequently repaired or replaced, and can be remounted upon the rotary drive shaft 372 so as to be re-engaged with its pump drive gear 376. It is lastly noted that in order to fixedly secure each pump drive gear 376 and each Belleville washer 448 at their predetermined axial positions upon the rotary drive shaft 372, a pair of retaining rings 450 are fixedly mounted upon the rotary drive shaft 372 so as to engage axially outer surface portions of each pump drive gear 376 and Belleville washer 448.

It may thus be seen that in accordance with the principles and teachings of the present invention, there has been disclosed a new and improved gear pump assembly, and a new and improved hot melt adhesive applicator assembly having a plurality of the new and improved gear pump assemblies of the present invention incorporated therein, wherein each gear pump assembly is mounted upon the applicator assembly in an entirely independent manner such that each gear pump assembly can be individually removed from the applicator assembly, and replaced back onto the applicator assembly, as may be necessary in connection with, for example, repair or maintenance procedures. The independence of each gear pump assembly also effectively prevents damage to one gear pump assembly from adversely affecting the operation of the other gear pump assemblies. Furthermore, in view of the fact that a driven gear of each gear pump assembly projects radially outwardly through an end face of the gear pump assembly so as to operatively engage a common drive shaft of the applicator assembly, as opposed to having the common drive shaft of the applicator assembly pass through side portions or faces of all of the gear pump assemblies, not only is the aforenoted independent mounting of the plurality of gear pump assemblies upon the applicator assembly facilitated, but in addition, the need for all dynamic shaft seals, normally necessarily provided between the common drive shaft and one of the gear members of each gear pump assembly, has been oviated and eliminated. In this manner, sources or origins of adhesive material leakage from the gear pump assemblies have been accordingly eliminated.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A gear pump assembly, for use in conjunction with a liquid dispensing assembly which comprises a drive shaft which is adapted to operatively engage and drive at least one gear pump assembly, wherein the gear pump assembly will output a predetermined metered amount of liquid and comprises:

a gear pump housing;

a gear pump inlet defined upon said gear pump housing through which liquid material, to be supplied, is conducted into said gear pump housing;

a gear pump outlet defined upon said gear pump housing through which liquid material, to be supplied, is conducted out from said gear pump housing;

a pump drive gear disposed within said gear pump housing for conducting liquid material, to be dispensed from said gear pump assembly, from said gear pump inlet toward said gear pump outlet; and a driven gear disposed in enmeshed engagement with said pump drive gear for driving said pump drive gear and rotatably disposed within said gear pump housing upon a rotary shaft which is disposed entirely within said gear pump housing such that external rotary dynamic seals are obviated.

2. The gear pump assembly as set forth in claim 1, wherein:

said driven gear has a first arcuate portion disposed internally within said gear pump housing and disposed in enmeshed engagement with said pump drive gear for driving said pump drive gear, and has a second arcuate portion projecting externally outwardly from said gear pump housing for enmeshed engagement with the drive shaft of the liquid dispensing assembly so as to be driven by the drive shaft of the liquid dispensing assembly.

3. The gear pump assembly as set forth in claim 1, wherein:

said gear pump housing comprises a pair of side plates and an intermediate plate;

said intermediate plate has a plurality of cut-out regions defined therein; and said pump drive gear and said driven gear are rotatably disposed within said cut-out regions defined within said intermediate plate such that said pump drive gear and said driven gear are disposed in a substantially coplanar manner with respect to said intermediate plate.

4. The gear pump assembly as set forth in claim 3, wherein:

said pump drive gear and said driven gear are respectively fixedly mounted upon shafts; and opposite ends of said shafts are rotatably mounted upon internal surface portions of said side plates of said gear pump housing so as not to extend through said side plates of said gear pump housing whereby rotary dynamic shaft seals, for said pump drive gear and driven gear shafts, are not required to be provided upon said gear pump housing.

5. The gear pump assembly as set forth in claim 3, wherein:

said gear pump inlet is defined within said intermediate plate; and said gear pump outlet is defined within one of said side plates.

6. The gear pump assembly as set forth in claim 5, further comprising:

a pump idler gear enmeshed with said pump drive gear so as to be driven by said pump drive gear;

a pair of liquid inlet flow paths, defined between said driven gear and one of said cut-out regions defined within said intermediate plate, for conducting the liquid, to be dispensed, toward said pump idler gear and said pump drive gear;

a common liquid inlet cavity, defined within said intermediate plate, for receiving liquid from both said pump idler gear and said pump drive gear; and a liquid outlet cavity defined within said one of said side plates and fluidically connected to said common liquid inlet cavity and to said gear pump outlet so as to transmit the liquid, to be dispensed, to said gear pump outlet.

7. The gear pump assembly as set forth in claim 3, wherein:

said second arcuate portion of said driven gear projects outwardly from an end face of said intermediate plate so as to project outwardly from an end surface portion of said gear pump housing.

8. The gear pump assembly as set forth in claim 7, further comprising:

fastener means projecting outwardly from said end surface portion of said gear pump housing for mounting said gear pump housing upon the applicator assembly.

9. The gear pump assembly as set forth in claim 8, wherein:

said fastener means comprises first and second fasteners projecting outwardly from respective end faces of each one of said pair of side plates.

10. The gear pump assembly as set forth in claim 1, wherein:

said gear pump housing comprises a pair of side plates; and said pump drive gear and said driven gear are mounted upon shafts which are rotatably disposed within said pair of side plates.

11. A liquid dispensing assembly, comprising:

a rotary drive shaft;

at least one drive gear mounted upon said rotary drive shaft so as to be rotatable with said rotary drive shaft; and at least one gear pump assembly for outputting a predetermined metered amount of liquid;

said at least one gear pump assembly comprising a gear pump housing; a gear pump inlet defined upon said gear pump housing through which liquid material, to be dispensed, is conducted into said gear pump housing; a gear pump outlet defined upon said gear pump housing through which liquid material, to be dispensed, is conducted out from said gear pump housing; a pump drive gear disposed within said gear pump housing for conducting liquid material, to be dispensed from said liquid dispensing assembly, from said gear pump inlet toward said gear pump outlet; and a driven gear disposed in enmeshed engagement with said pump drive gear for driving said pump drive gear and rotatably disposed within said gear pump housing upon a rotary shaft which is disposed entirely within said gear pump housing such that external rotary dynamic seals are obviated.

12. The liquid dispensing assembly as set forth in claim 11, wherein:

said at least one drive gear comprises a plurality of drive gears; and said at least one gear pump assembly comprises a plurality of gear pump assemblies.

13. The liquid dispensing assembly as set forth in claim 12, wherein:

each one of said driven gears of said plurality of gear pump assemblies has a first arcuate portion disposed internally within a respective one of said gear pump housings and disposed in enmeshed engagement with said pump drive gear for driving said pump drive gear, and has a second arcuate portion projecting externally outwardly from said gear pump housing for enmeshed engagement with a respective one of said plurality of drive gears, which are mounted upon said rotary drive shaft which is disposed externally of each one of said gear pump housings such that each one of said plurality of drive gears is disposed externally of each one of said gear pump housings, so as to be driven by said respective one of said plurality of drive gears mounted upon said rotary drive shaft of said liquid applicator assembly.

14. The liquid dispensing assembly as set forth in claim 13, wherein:

said second arcuate portion of each one of said driven gears projects outwardly from an end surface portion of each one of said gear pump housings whereby said plurality of gear pump assemblies are able to be disposed in a side-by-side arrangement.

15. The liquid dispensing assembly as set forth in claim 13, wherein:

said second arcuate portion of each one of said driven gears projects outwardly from an end surface portion of each one of said gear pump housings so as to be respectively independently engageable with and disengageable from said liquid dispensing assembly as a result of being respectively independently engageable with and disengageable from each one of said plurality of drive gears mounted upon said rotary drive shaft.

16. The liquid dispensing assembly as set forth in claim 15, further comprising:

a plurality of torque-overload release clutch mechanisms fixedly mounted upon said rotary drive shaft and respectively operatively engaged with said plurality of drive gears mounted upon said rotary drive shaft for independently imparting rotational drive to said plurality of drive gears mounted upon said rotary drive shaft in a torque-overload release manner whereby if a particular one of said plurality of gear pump assemblies experiences an operational failure, remaining ones of said plurality of gear pump assemblies can continue to operate.

17. The liquid dispensing assembly as set forth in claim 11, wherein:

each one of said plurality of gear pump housings comprises a pair of side plates and an intermediate plate;

each one of said pump drive gears and said driven gears are respectively fixedly mounted upon shafts; and opposite ends of each one of said shafts are rotatably mounted upon internal surface portions of said side plates of each one of said gear pump housings so as not to extend through each one of said side plates of each one of said gear pump housings whereby rotary dynamic shaft seals, for each one of said pump drive gear and said driven gear shafts, are not required to be provided upon any one of said gear pump housings.

18. The liquid dispensing assembly as set forth in claim 17, wherein:

each one of said intermediate plates of each one of said gear pump housings has a plurality of cut-out regions defined therein; and each one of said pump drive gears and said driven gears are rotatably disposed within said cut-out regions defined within each one of said intermediate plates such that said pump drive gears and said driven gears are disposed in a substantially coplanar manner with respect to said intermediate plates.

19. The liquid dispensing assembly as set forth in claim 17, wherein:

each one of said gear pump inlets is defined within each one of said intermediate plates; and each one of said gear pump outlets is defined within one of said side plates.

20. The liquid dispensing assembly as set forth in claim 19, further comprising:

a pump idler gear enmeshed with each one of said pump drive gears so as to be respectively driven by said pump drive gears;

a pair of liquid inlet flow paths, defined between each one of said driven gears and one of said cut-out regions defined within each one of said intermediate plates, for conducting the liquid, to be dispensed, toward each one of said pump idler gears and each one of said pump drive gears;

a common liquid inlet cavity, defined within each one of said intermediate plates, for receiving liquid from both of said pump idler gear and said pump drive gear; and a liquid outlet cavity defined within said one of said side plates and fluidically connected to each one of said common liquid inlet cavities and to each one of said gear pump outlets so as to transmit the liquid, to be dispensed, to each one of said gear pump outlets.

21. The liquid dispensing assembly as set forth in claim 17, further comprising:

a drive gear manifold;

said rotary drive shaft, having said plurality of drive gears mounted thereon, extending through said drive gear manifold; and fastener means projecting outwardly from end surface portions of each one of said gear pump housings for mounting each one of said gear pump housings upon said drive gear manifold in said side-by-side arrangement.

22. The liquid dispensing assembly as set forth in claim 21, wherein:

said fastener means comprises first and second fasteners projecting outwardly from respective end faces of each one of said pair of side plates.

23. The liquid dispensing assembly as set forth in claim 21, further comprising:

an adapter manifold mounted upon said drive gear manifold;

a plurality of control valve assemblies mounted upon said adapter manifold;

a plurality of dispensing nozzles respectively fluidically connected to each one of said plurality of control valve assemblies for dispensing liquid material onto a substrate; and a plurality of fluid passageways defined within said drive gear manifold and said adapter manifold for respectively connecting said gear pump outlet of each one of said gear pump housings to a respective one of said plurality of dispensing nozzles.

24. The liquid dispensing assembly as set forth in claim 23, further comprising:

a plurality of solenoid valve assemblies mounted upon said adapter manifold and respectively associated with each one of said plurality of control valve assemblies so as to operatively actuate each one of said control valve assemblies for controlling the dispensing of the liquid material from said dispensing nozzles.

25. The liquid dispensing assembly as set forth in claim 24, wherein:

each one of said plurality of solenoid valve assemblies comprises a pneumatic solenoid valve assembly;

a first pneumatic control line is defined within said adapter manifold for fluidically interconnecting each one of said solenoid valve assemblies to a respective one of said control valve assemblies for actuating said respective one of said control valve assemblies to an OPENED position; and a second pneumatic control line is defined within said adapter manifold for fluidically interconnecting each one of said solenoid valve assemblies to said respective one of said control valve assemblies for actuating said respective one of said control valve assemblies to a CLOSED position.

26. The liquid dispensing assembly as set forth in claim 11, wherein:

said gear pump housing comprises a pair of side plates; and said pump drive gear and said driven gear are mounted upon shafts which are rotatably disposed within said pair of side plates.

27. A gear pump assembly, for use in conjunction with a liquid dispensing assembly which comprises a drive shaft which is adapted to operatively engage and drive at least one gear pump assembly, wherein the gear pump assembly will output a predetermined metered amount of liquid and comprises:

a gear pump housing;

a gear pump inlet defined upon said gear pump housing through which liquid material, to be supplied, is conducted into said gear pump housing;

a gear pump outlet defined upon said gear pump housing through which liquid material, to be supplied, is conducted out from said gear pump housing;

a pump drive gear disposed within said gear pump housing for conducting liquid material, to be dispensed from said gear pump assembly, from said gear pump inlet toward said gear pump outlet; and a pump idler gear disposed in enmeshed engagement with said pump drive gear and cooperating with said pump drive gear for conducting the liquid material, to be dispensed from said gear pump assembly, from said gear pump inlet toward said gear pump outlet, said pump drive gear and said pump idler gear being rotatably disposed within said gear pump housing upon rotary shafts which are disposed entirely within said gear pump housing such that external rotary dynamic seals are obviated.

28. The gear pump assembly as set forth in claim 27, further comprising:

a driven gear disposed in enmeshed engagement with said pump drive gear for driving said pump drive gear and also rotatably disposed within said gear pump housing upon a rotary shaft which is disposed entirely within said gear pump housing such that external rotary dynamic seals are obviated.

* * * * *